United States Patent [19]

Giesch

[11] Patent Number: 4,667,955

[45] Date of Patent: May 26, 1987

[54] HYDRAULIC UNIVERSAL GYM

[76] Inventor: Nick J. Giesch, Rt. 1, Box 45A, Newberg, Oreg. 97132

[21] Appl. No.: 728,799

[22] Filed: Apr. 30, 1985

[51] Int. Cl.[4] ..... A63B 21/00

[52] U.S. Cl. ..... 272/130; 272/134

[58] Field of Search ..... 272/130, DIG. 1, DIG. 4, 272/134, 93, 144, 143, 103, 136; 248/231.1, 231.4, 295.1

[56] References Cited

U.S. PATENT DOCUMENTS

| | | | |
|---|---|---|---|
| 2,313,532 | 3/1943 | Garrett | 248/295.1 X |
| 3,128,094 | 4/1964 | Wolf | 272/130 |
| 3,369,403 | 2/1968 | Carlin et al. | 272/130 X |
| 3,495,824 | 2/1970 | Cuinier | 272/130 |
| 4,235,437 | 11/1980 | Ruis et al. | 272/134 |
| 4,353,547 | 10/1982 | Jenkinson | 272/130 |
| 4,397,462 | 8/1983 | Wilmarth | 272/134 X |
| 4,492,375 | 1/1985 | Connelly | 272/134 |
| 4,576,377 | 3/1986 | Wolff | 272/130 |
| 4,582,320 | 4/1986 | Shaw | 272/136 |

FOREIGN PATENT DOCUMENTS

| | | | |
|---|---|---|---|
| 405617 | 4/1967 | United Kingdom | 272/130 |
| 2146910A | 5/1985 | United Kingdom | 272/130 |

*Primary Examiner*—Richard J. Apley
*Assistant Examiner*—Roberts W. Bahr
*Attorney, Agent, or Firm*—Olson and Olson

[57] ABSTRACT

An hydraulic universal gym comprises a floor supported base having an exercise platform thereon, the base releasably mounting a vertically extending, rearwardly inclining upright assembly arranged to receive a vertically adjustable exercise lever arm pivotally thereon. A double acting hydraulic piston-cylinder unit is pivotally mounted at its rear end to the upright assembly a spaced distance below the pivotally mounted lever arm, and includes a piston rod which extends outwardly from each end of the cylinder, the forward end of the piston rod extending from the front of the cylinder being pivotally connected to the lever arm a spaced distance outwardly of the arm's pivotal attachment to the upright. A fluid pressure control manifold is provided to connect together the opposite ends of the cylinder on opposite sides of the piston and selectively regulate the fluid flow therebetween, adjustably regulating the resistance applied to the exercise lever arm connected to the piston in both of the arm's upward and downward movements about its pivot on the upright assembly.

2 Claims, 5 Drawing Figures

5-10°

HYDRAULIC UNIVERSAL GYM

BACKGROUND OF THE INVENTION

This invention relates to universal type exercising gyms, and more particularly to such exercise gyms utilizing fluid pressure cylinders which replace more conventional dead weights, coil springs, elastic bands and the like for resisting movement of the exercise lever arms associated therewith.

Universal gyms using hydraulic cylinders as source of resistance for exercising purposes are known in the art, and illustrative of the general principles are U.S. Pat. No. Des. 230,613 and U.S. Pat. Nos. 4,275,892 and 4,397,462.

All of the above illustrate basically an exercise lever assembly attached pivotally to a vertical upright which is either mounted to a base platform or bench, or to a wall, or both. An hydraulic or pneumatic cylinder also connects the lever assembly to the upright below the pivot axis of the lever and is adjustably mounted to the lever in order to vary the working stroke of the cylinder and lever arm and for adjusting the resistance applied to the lever by the cylinder.

In each of the utility patents listed above, the working range of the lever arm of the gym is adjustable by moving the connection of the cylinder inwardly and outwardly along the arm, the resulting positions of the arm and its throw thus being determined by the particular stroke of the piston and the particular disposition of the piston mount on the lever arm. The resistive force applied against the lever arm is varied in the first utility patent listed above by moving the connection point of the cylinder to the lever arm longitudinally along the lever arm toward and away from its pivotal mount to the wall bracket, thereby reducing the working stroke of the exercise lever arm as resistance on it by the cylinder is increased. In the second reference above, the resistance offered against the exercise arm by the pneumatic cylinder is varied through use of a complex construction involving a check valve connecting the cylinder to a large air reservoir and an outside air pump which together control the desired pressure.

In all universal gym constructions utilizing an exercise lever arm assembly, the applicant is not aware of any gym arranged to provide an arm working stroke that allows the handle members associated therewith to travel substantially vertically from their fully lowered to their fully raised positions during exercising. The inherently arcuate paths of travel of the handle members of universal gyms of the prior art consequently require the user to step backward as the lever arm is raised, to maintain balance; causes increased strain on the users back; and creates a potentially dangerous situation should the user be thrown off balance and lose his grip on the weighted arm.

SUMMARY OF THE INVENTION

In its basic concept, this invention provides a free standing, portable universal gym which utilizes a double acting hydrulic cylinder to provide infinitely adjustable, consistently equalized resistive force against movement of an exercise lever in both vertical directions thereof, without requiring reconnecting and readjusting the mechanical components of the gym itself and without requiring outside power sources, large fluid reservoirs, or other such apparatus.

It is by virtue of the foregoing basic concept that the principle objective of this invention is achieved; namely, the provision of a universal gym which overcomes the aforementioned disadvantages and limitations of earlier universal gyms of the prior art.

Another important object of this invention is the provision of the universal gym of the class described in which the working movement of the handle member associated with the exercise lever is always substantially vertical throughout its upward and downward range, regardless of the particular height disposition of the lever assembly relative to a supporting floor.

A further object of this invention is the provision of the universal gym of the class described which is of simplified construction for economical manufacture, ease of assembly and disassembly for transportation and storage, and simplicity of operation.

DESCRIPTION OF THE PREFERRED EMBODIMENT

Figures 1, 2, 3, 4, 5:
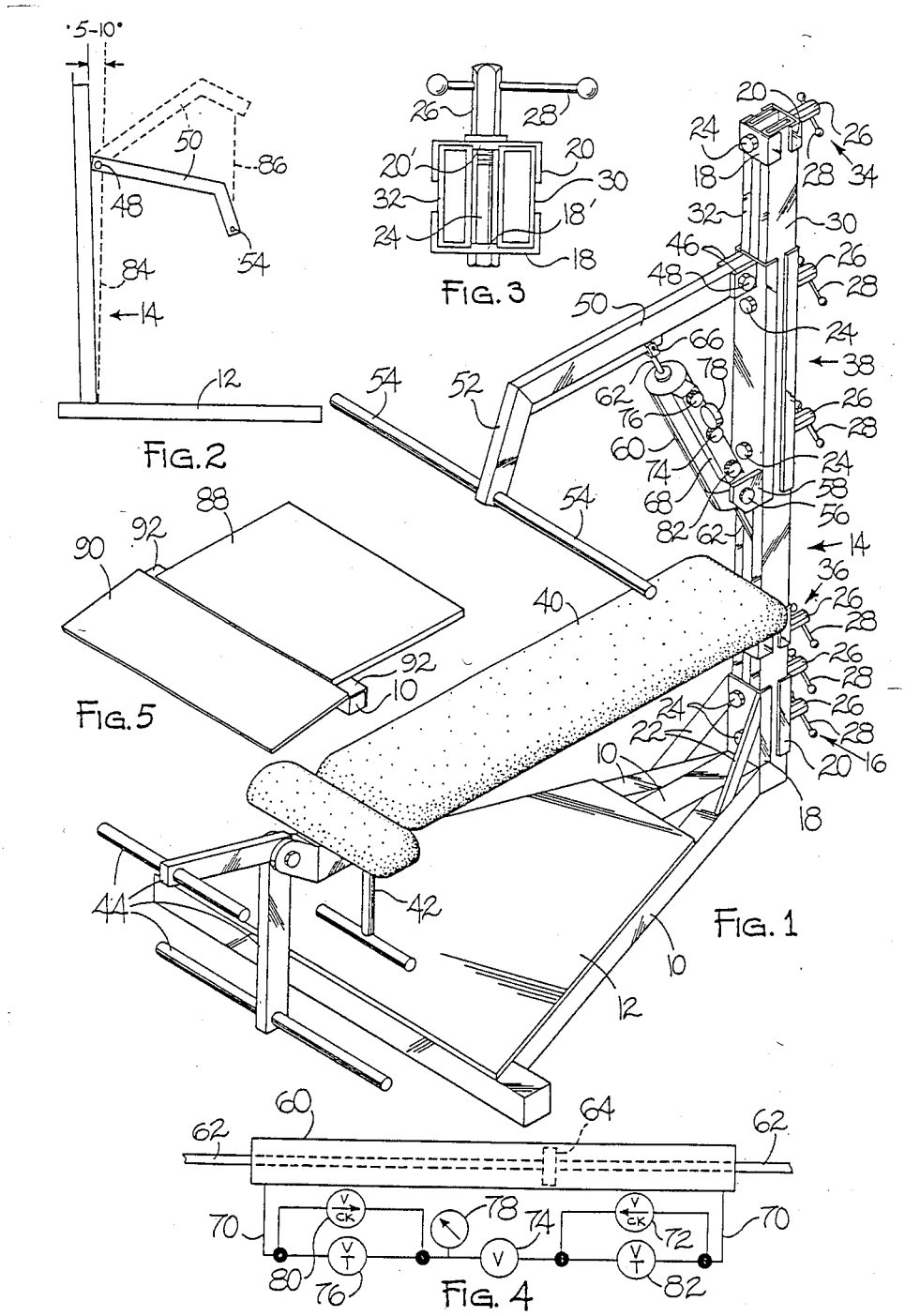
FIG. 1 is a perspective view of a universal exercise gym embodying the features of this invention shown in assembled, operational condition with a weight bench provided.
FIG. 2 is a schematic side elevation of the basic framework of the gym illustrating in broken lines the desired patch of the upright assembly and the resulting vertical movement of the handle members associated with the exercise lever arm.
FIG. 3 is an enlarged plan view of the upright assembly as viewed from the top of FIG. 1.
FIG. 4 is a fragmentary schematic diagram of the hydraulic cylinder and the manifold associated therewith.
FIG. 5 is a perspective view of an alternative platform designed to accommodate a wheelchair.

Referring to FIG. 1 of the drawings, a universal gym embodying the features of this invention includes a base comprising support members 10 arranged for disposition on a ground surface and a raised platform 12 provided on the top of the support members 10. The base includes mounting means for securing a support member, illustrated generally as upright assembly 14, in vertically extending position therefrom.

In the embodiment illustrated, this mounting means comprises a two component bracket assembly 16 configured as a pair of upwardly extending, longitudinally elongated U-shaped channel members 18 and 20. One channel member 18 is mounted to the base and reinforced thereon by support bracket 22. The other channel member 20 of the pair is arranged in confronting position relative to member 18, as shown, and captures the upright assembly 14 therebetween. Clamping means, illustrated herein as bolts 24, interconnect the channel members 16 and 18 through aligning bores in each, and nuts 26 with cross-bar handles 28 are provided on the bolts to releasably clamp the upright assembly 14 in frictional engagement between the confronting brackets.

As shown best in FIG. 2, the disposition of the upwardly extending assembly 14 relative to the base is preferably not vertical, but rather is tilted rearward about 5 to 10 degrees off the vertical. The obtuse angle thus formed between the base and the upright assembly is considered quite important, for reasons which will be discussed later.

As seen best in FIGS. 1 and 3, the upright assembly 14 embodied herein comprises two parallel spaced apart longitudinally elongated beams 30 and 32 joined together by the lower clamping bracket 16 and by similarly constructed upper and intermediate clamping bracket assemblies 34, 36 and 38, respectively. As FIG. 3 illustrates, each clamping bracket comprises a pair of U-shaped channel members 18 and 20 configured to capture the upright beams 30 and 32 therebetween. Each bracket includes a central spacer 18' and 20' provided to maintain the separation between the beams 30 and 32. A tightening bolt 24 is arranged to extend through bores in each U-shaped channel member between the spaced apart upright beams, and a nut 26 with cross-bar handle 28 is provided on the end of each bolt to move the U-shaped bracket members relative to each other to releasably clamp the upright beams between them in frictional engagement.

The channel member 18 of the clamping bracket assembly 30 adjacent the lowermost clamping bracket assembly 16 mounts a conventional exercise bench 40. The opposite end of the bench is supported by a pivotal pedestal leg member 42 arranged to be supported by the platform 12. The bench also includes a conventional pivoted leg exercising weight assembly 44 typical in the art.

The upright assembly 14 also releasably supports the next upper clamping bracket assembly 38 which provides means for securing an exercise lever arm and a double acting hydraulic cylinder adjustably thereto. In the embodiment illustrated, a pair of longitudinally elongated, U-shaped channel members 18 and 20 are arranged to clamp onto the upright assembly 14 by means of bolts 24 and nut 26. As seen in FIG. 1, this clamping arrangement also provides simplified means by which the bracket 38 may be adjusted vertically along the upright.

The channel member 18 of bracket 38 includes at its upper end a pair of spaced flanges 46 which support a pivot bolt 48. The bolt is arranged to pivotally receive the inner end of an exercise lever arm 50. This arm extends outwardly from the upright over the platform 12, and includes an outer offset portion 52 which mounts handles 54.

Fluid pressure cylinder means connects the lever arm 50 to a pivot bolt 56 supported by flanges 58 on the lower end of the channel member 18 of bracket 38. The resulting stroke of the lever arm is determined by the stroke of the cylinder means connected thereto. As illustrated, the cylinder means comprises a double acting hydraulic cylinder 60 having a piston rod 62 extending therethrough so as to provide equal areas on both sides of the piston 64, to equalize working pressures in both directions of the stroke. The portion of the piston rod 62 extending upwardly out of the hydraulic cylinder is pivotally attached to the lever arm 50 at pivot 66. The piston rod portion extending downwardly from the piston and out of the cylinder is allowed free movement between the upright beams 30 and 32 as the cylinder is operated by moving the lever arm up and down.

Regulator means, embodied herein as an hydraulic manifold 68 is provided in conjunction with the cylinder 60 to regulate the fluid pressure between both sides of the double acting cylinder. A schematic diagram of the manifold is shown in FIG. 4 of the drawings.

With reference to FIG. 4, it is to be noted that the manifold provides means by which the resistive pressure applied against the lever arm 50 by the cylinder 60 may be adjusted selectively in both operating directions of movement of the arm. Fluid line 70 connects the opposite ends of the cylinder together, so that fluid may move from one end of the cylinder to the other as the piston 64 moves in response to the user operating the exercise lever arm.

As the piston is moved downwardly (to the right in FIG. 4), when the user is pulling down on the lever arm 50, fluid under pressure is forced through the right end of line 70, through check valve 72, through main shut-off valve 68, through throttle valve 76 and thence freely into the top end of the cylinder through line 70. Valve 76 is adjustable to select the desired resistance or back pressure on the fluid. Pressure meter 78 registers the resistance in pounds or kilograms to advise the user of the weight equivalence resisting his efforts.

When the direction of travel of the arm 50 is reversed, in this case for weightlifting, and the arm is moved upwardly, fluid is forced in the reverse direction through check valve 80, through main shut-off valve 74, and through throttle valve 82 into the lower end of the cylinder. The throttle valve 82 thus controls fluid resistance in this direction.

The main shut-off valve 74 operates to prevent fluid passage in either direction when movement of the lever arm is not desired. Storing, transporting, assembling and disassembling the apparatus are examples of instances when it may be desired that the lever arm not be movable for convenience or safety. Also, the arm may be moved upwardly and the main shut-off valve 74 closed, thus making the apparatus usable as a chin-up bar, for the arm is consequently rigidly locked into the desired raised position. Further, the arm may be locked in other positions of adjustment for isometric exercises.

As mentioned previously, the unique angular disposition of the upright assembly 14 is important in the desired movement of the exercise lever arm. As seen best in FIG. 2, with the pivot bolt 48 of the lever arm disposed rearwardly of the vertical line 84 on the angularly extending upright, the resulting path of movement of the handles 54 during the up and down strokes of the arm 50 is substantially along the vertical line 86 between their lowered and raised positions. This is a very desirable feature to a user standing, sitting or reclining in a stationary position because he does not have to physically accommodate the sizably arcuate paths of arm travel typical of gyms of the prior art that results in the handles being disposed further away from the upright in their raised position than in their fully lowered position. This means that the user is not compelled to step or lean toward and away from the upright as he lowers and raises the resisting exercise lever arm during exercise.

Finally, FIG. 5 illustrates another embodiment of a base platform 88 as an alternative to the exercise platform 12 described earlier and shown in FIG. 1. This particular version is best suited for supporting a wheelchair in desired positions relative to the exercise lever arm 50. Access to the raised platform on the base 10 by a wheelchair is accommodated through use of a ramp 90 having hook brackets 92 arranged to engage the base 10, as shown.

Including initial setup, the operation of the hydraulic universal gym of this invention is as follows: Firstly, the base 10 including the platform 12 or 88 is placed on a floor in a desired location. The upright assembly 14 of beams 30 and 32 is held together by bracket assemblies 16 and 34. The bracket assembly 38, supporting cylinder 60 and lever arm 50, is clamped to the upright assembly by tightening the nuts 26 to draw the channel members 18 and 20 into clamping engagement with the beams 30 and 32. If desired, exercise bench 40 is connected to the channel member 18 of assembly 36, the pivotal leg member 42 supporting the outer end of the bench on the platform 12. The bracket assembly 38 is adjusted along the upright assembly 14, by loosening nuts 26, to position the lever arm 50 at a desired height. The nuts then are retightened to secure the lever in selected position. The universal gym is now ready for use.

The user then moves the lever arm up or down and adjusts one or both of the throttle valves 76 and 82 to establish the desired resistance on the arm in whichever direction of movement he chooses. The resistance is shown to him in pounds or kilograms by the meter 78. He then exercises in his desired manner, readjusting the resistance as he wishes by simply turning the appropriate valve 76 or 82.

Should he desire, the user may then push the lever arm 50 to his uppermost reach, close the main shut-off valve 74, and then do chin-ups using the lever arm handles 54 thus rigidly locked into that position. Similarly, if he desires to do bench exercises, the lever arm may be moved upwardly and locked in that position so that the lever arm and handles are maintained out of the way. When finished with bench exercises, opening the valve 74 automatically returns the hydraulic system to the various resistances already preset by the throttle valve 76 and 82, thus not requiring their further adjustment.

The weight bench 40 illustrated is used in conventional manner, well known in the art. Additional versatility may be offered the user in sliding the bench mounting bracket assembly 36 vertically along the upright 14 for adjusting the angular disposition of the head of the bench. The opposite end of the bench may also be adjusted angularly by pivoting or removing the supporting pedestal leg 42, if desired.

From the foregoing it will be apparent that the present invention provides a universal exercise gym that demonstrates a number of uniquely desirable features of both construction and operation. Initially, the gym is specifically arranged for ease of assembly and disassembly, facilitating its portability and storage. The apparatus is completely self-containted, requiring no outside wall supports, power supplies, fluid reservoirs, or the like, and takes up a minimum of floor space while providing all of the features typical of universal type gyms.

This gym also affords the user an extremely wide degree of exercise options previously unavailable in earlier gyms without requiring considerable time and effort spent on the user's part rearranging the various components associated with the gym. For example, the user may select a weight lifting mode, whereby infinitely adjustable resistive force may be provided only upon raising the lever, the subsequent downward stroke of the lever arm being unrestricted. Or, resistance may be provided in only the downward stroke of the arm. Alternatively, both upward and downward lever arm travel may be arranged to provide resistance to the user, in equal or different preselected weights in each direction as may be desired. Even more, the lever arm may be locked into any desired position of extension to provide a chinning bar. The strength of the dual beam structure of the upright assembly 14 gives the gym the same useful range as stationary gyms costing several times as much.

The height adjustment of the lever arm of the gym of this invention is arranged to be varied completely independently of the operation of the cylinder connected thereto. Therefore adjustment of the height of the lever arm above the base or the bench during various different exercises does not effect the weight settings or require readjustment of the cylinder's connection to any part of the gym.

The working stroke of the exercise lever arm of the gym of this invention is specifically arranged, by virtue of its connection to the angularly extending upright assembly, to always be substantially vertical despite any particular height disposition of the lever arm assembly relative to the base of the gym. Thus, the previously inherent arcuate lever arm stroke of prior art gyms is avoided.

It will be apparent to those skilled in the art that various changes other than those already described may be made in the size, shape, type, number and arrangement of parts described hereinbefore without departing from the spirit of this invention and the scope of the appended claims.

Having thus described my invention and the manner in which it may be used, I claim:

1. A universal gym, comprising:

(a) a base mounting an exercise platform thereon, (b) an elongated upright support mounted on said base, (c) a clamp assembly mounted on the upright support for adjustment along the latter, (d) an exercise lever arm pivotally connected at its inner end to the clamp assembly a spaced distance above the bottom thereof, (e) a self-contained double acting hydraulic piston-cylinder unit connected pivotally at one end to the clamp assembly and at the opposite end to the lever arm outwardly of its inner end, (f) hydraulic fluid passageway means interconnecting the opposite ends of the cylinder for allowing hydraulic fluid flow in both directions, (g) a pair of regulating valves in the passageway means arranged to adjust the flow of hydraulic fluid between the opposite ends of the cylinder, and (h) a pair of check valves in the passageway means each associated with a different regulating valve and each arranged to allow fluid flow in a different direction, (i) the pair of regulating valves being arranged in the passageway means in series, and each check valve is arranged in parallel with its associated regulating valve, whereby to permit selective adjustment of the restriction of flow of hydraulic fluid in one direction independently of the adjustment of flow in the opposite direction to selectively control the amount of pressure required to move the piston in one direction while also allowing independent, selective control of the amount of pressure required to move the piston in the opposite direction, (j) said elongated upright support comprising a pair of laterally spaced apart beams and including a pair of bottom clamp members, one secured to the base and supporting one side of the beams and the other abutting the opposite side of the beams, and a clamp bolt extending between the clamp members for releasably clamping the beams between them, a pair of top clamp members abutting the opposite sides of the beams at the upper ends thereof, and a clamp bolt extending between the clamp members for releasably clamping the beams between them, and a pair of intermediate clamp members abutting the opposite sides of the beams between the bottom and top clamp pairs, and a clamp bolt extending between the intermediate clamp members for releasably clamping the beams between them, the pair of intermediate clamp members pivotally mounting the exercise lever arm at its inner end and one end of the hydraulic cylinder.

2. The universal gym of claim 1 including a second pair of intermediate clamp members abutting the opposite sides of the beams between the bottom and the first named intermediate clamp members, and a clamp bolt extending between the second intermediate clamp members for releasably clamping the beams between them, and an exercise bench supported at its inner end by one of the clamp members of the second intermediate pair.

* * * * *